US005948737A

United States Patent [19]

Srinivasan et al.

[11] Patent Number: 5,948,737

[45] **Date of Patent: *Sep. 7, 1999**

[54] MINERAL OR SYNTHETIC, HYDROGEN-BASED GREASES, HAVING IMPROVED PROPERTIES

[75] Inventors: Padmanabhan Srinivasan, Milan; Laura Montagna, Arese; Paolo Savelli, Bresso; Costante Corti, Milan, all of Italy

[73] Assignee: Ausimont S.p.A., Milan, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/752,179

[22] Filed: Nov. 18, 1996

Related U.S. Application Data

[62] Division of application No. 08/350,159, Nov. 30, 1994, abandoned.

[30] Foreign Application Priority Data

| | | | |
|---|---|---|---|
| Jan. 12, 1993 | [JP] | Japan | 5-329771 |
| Mar. 7, 1994 | [IT] | Italy | MI94A0412 |

[51] Int. Cl.[6] ..... C10M 105/54; C07C 43/16

[52] U.S. Cl. ..... 508/582; 568/615

[58] Field of Search ..... 508/582; 568/615

[56] References Cited

U.S. PATENT DOCUMENTS

| | | | |
|---|---|---|---|
| 2,242,218 | 5/1941 | Auer . | |
| 3,214,478 | 10/1965 | Milian . | |
| 3,665,041 | 5/1972 | Sianesi et al. . | |
| 3,715,378 | 2/1973 | Sianesi et al. . | |
| 3,793,198 | 2/1974 | Chapman | 252/28 |
| 3,980,572 | 9/1976 | Dodo et al. | 252/36 |
| 3,981,812 | 9/1976 | Zietz | 252/49.6 |
| 4,251,431 | 2/1981 | Carswell | 252/40.7 |
| 4,324,673 | 4/1982 | Christian et al. | 252/58 |
| 4,442,290 | 4/1984 | Caporiccio et al. | 252/58 |
| 4,523,039 | 6/1985 | Lagow et al. . | |
| 4,657,687 | 4/1987 | Caporiccio et al. | 252/54 |
| 4,836,944 | 6/1989 | Tohzuka et al. | 252/54 |
| 5,000,864 | 3/1991 | Strepporola et al. | 252/54 |
| 5,066,710 | 11/1991 | Omure et al. | 252/54 |
| 5,124,058 | 6/1992 | Corti et al. | 252/54 |
| 5,211,861 | 5/1993 | Lafratta et al. | 252/54 |
| 5,385,686 | 1/1995 | Miller | 252/54 |

FOREIGN PATENT DOCUMENTS

| | | |
|---|---|---|
| 0148482 | 7/1985 | European Pat. Off. . |
| 0340739 | 11/1989 | European Pat. Off. . |
| 0340793 | 11/1989 | European Pat. Off. . |
| 0344547 | 12/1989 | European Pat. Off. . |
| 0382224 | 8/1990 | European Pat. Off. . |
| 0435062 | 7/1991 | European Pat. Off. . |
| 1104482 | 2/1968 | United Kingdom . |
| 1226566 | 3/1971 | United Kingdom . |
| 8700538 | 1/1987 | WIPO . |

OTHER PUBLICATIONS

Smolheer, et al; Lubricant Additives, The Lezens–Hiles Co., 1967, p. 48.

*Primary Examiner*—Margaret Medley
*Attorney, Agent, or Firm*—Nikaido Marmelstein Murray & Oram, LLP

[57] ABSTRACT

Greases comprising a mineral and/or synthetic lubricating oil having an hydrogenated basis, a fluoropolyethereal oil and an organic or inorganic thickening agent, wherein the weight ratio lubricating oil+fluoropolyethereal oil/thickening agent ranges from 97:3 to 80:20 and the weight ratio lubricating oil/fluoropolyethereal oil ranges from 95:5 to 60:40.

14 Claims, 1 Drawing Sheet

MINERAL OR SYNTHETIC, HYDROGEN-BASED GREASES, HAVING IMPROVED PROPERTIES

Figure 1:
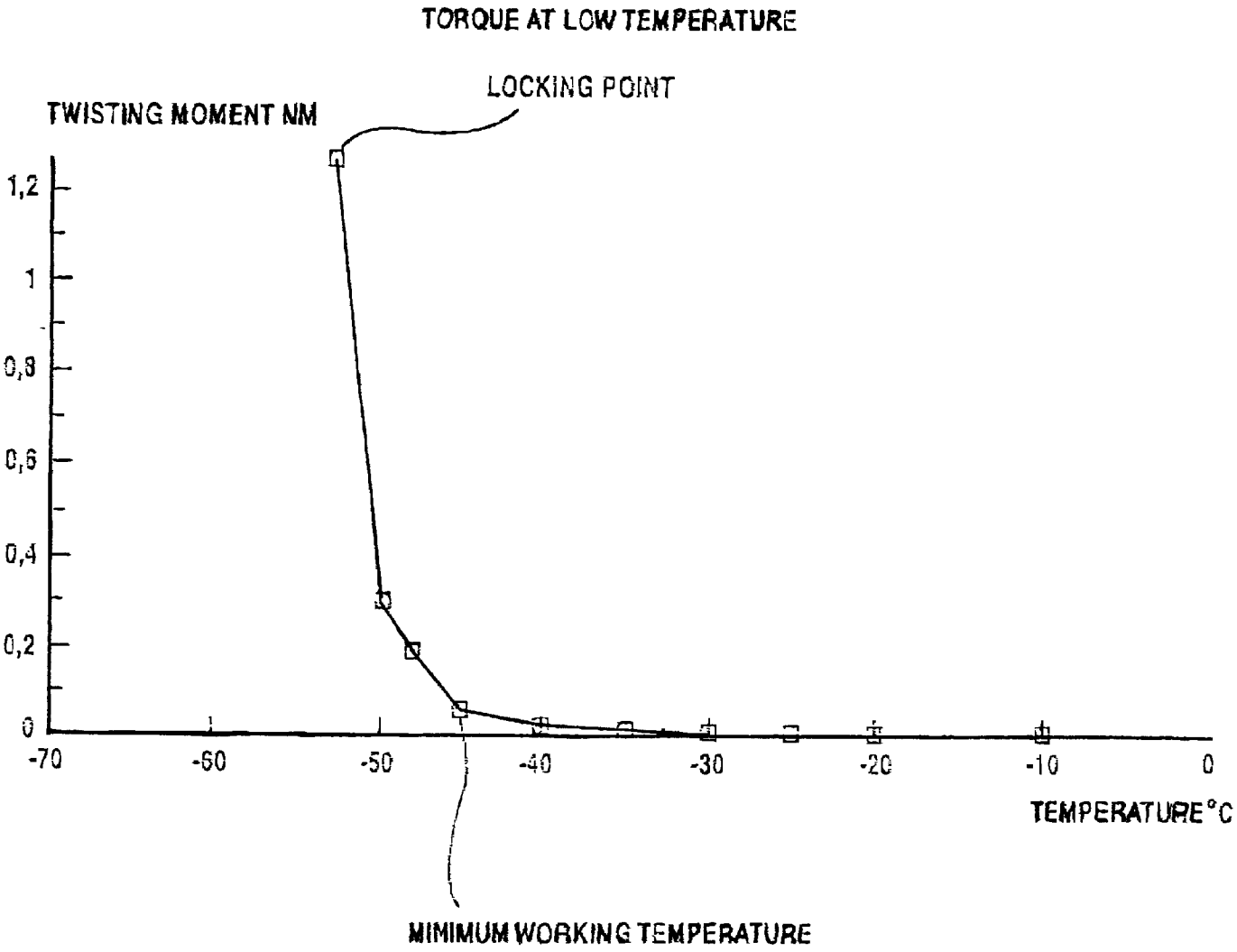

This application is a division of application Ser. No. 08/350,159 filed Nov. 30, 1994 which application is now abandoned.

The present invention relates to greases to be used with moving objects, one with respect to the other, and more specifically to semi-solid lubricants, commonly called greases.

More particularly the invention relates to mineral or synthetic greases showing improved properties.

It is well known that liquid, semi-solid and solid lubricants are used for decreasing the friction between mechanical parts moving one with respect to the other.

As lubricants are commonly used products of the group of mineral or synthetic oils and greases having an hydrogenated basis. With mechanical members where lubricants are difficult to feed continuously from the outside, a semi-solid lubricant, that is a grease, is generally used.

Grease is thixotropic, therefore fluid when in the state of motion, and is suited, therefore, for lubrication of members difficult for the liquid lubricant to be applied to; grease has moreover the advantage of simplifying the hermetic sealing of the member to be lubricated.

The preparation of a grease consists in mixing a base oil with a thickening charge, optionally also with additives. As base oil, a mineral or synthetic lubricant is mainly used.

As thickening charge, metallic soaps, polyureas or non-soaps such as for instance bentonite can be used.

Greases prepared with these oils are low-cost, but can be used in a limited temperature range, generally up to about 150° C.

The drawbacks shown by mineral and synthetic greases can therefore be summarized as follows:

not high working maximum temperature, above which greases become thermally unstable especially in the presence of an oxidizing environment;

once the working temperature has been set, the utilization time of these greases is however limited.

An essential parameter to establish the elevated durability of a grease at the working temperature, is the evaporation of the oil and above all the separation of the oil from the solid phase formed by the thickening charge.

A basic operation in preparing greases is in fact the so-called homogenizing phase of the mineral oil with the thickening charge.

The more homogeneously the mineral oil disperses in the thickening agent, the slower is its separation and theref the greater is the grease durability.

The essential parameter regulating homogenization and then separation is the compatibility of the oil with the thickening charge.

It is known in the art to add stabilizers and antioxidants to try to increase the chemical, thermal and thermo-oxidative stability of the grease and to decrease the separation of the oil.

Other additives can also be added, for instance antiwear and anticorrosion additives to improve these properties.

Viscosity index improvers are also added to have limited viscosity variation with the temperature.

The main problem is always the compatibility of all the components in order to obtain a grease having constant properties for all its life.

As a matter of fact, if there is not a very good compatibility, a loss of oil occurs, due to its quick separation, leading, on the one hand, to an increase of the mechanical torque necessary for moving the mechanical parts one relative to the other and on the other hand, after a certain time to locking.

When the lubricants and greases are used to reduce the local temperature of a rotating part, the torque necessary for moving the mechanical members one relative to the other quickly increases by decreasing the temperature below a certain level. The temperature at which such a quick increase of the slope of the torque/temperature curve occurs, is said to be the minimum working temperature, whereas the temperature at which the bearings completely lock after a further reduction of the temperature is said to be locking point (FIG. 1).

An object of the present invention are greases based on mineral or synthetic oils which overcome the drawbacks of the known greases and show the combination of the following properties:

less separation of oil from grease, greater durability of lubrication at the same working temperature and therefore a longer life of the grease, higher maximum working temperature of the greases in comparison with known mineral and synthetic greases, low cold locking temperature, low mechanical torque necessary for the working of the moving mechanical parts during the grease life, a minimum working temperature of the order of about −40° C. as required in most of the applications.

It has been surprisingly and unexpectedly found that it is possible to improve the combination of the parameters indicated above for mineral and/or synthetic greases by using a fluoropolyethereal oil as specified hereinunder.

Another object of the present invention is therefore greases comprising a mineral and/or synthetic lubricating oil having an hydrogenated basis, a fluoropolyethereal oil and an organic or inorganic thickening agent, wherein the weight ratio lubricating oil+fluoropolyethereal oil/thickening agent ranges from 97:3 to 80:20 and the weight ratio lubricating oil/fluoropolyethereal oil ranges from 95:5 to 60:40. The preferred values are comprised between 93:7 and 88:12 for the first ratio; and from 80:20 and 70:30 for the lubricating oil/fluoropolyethereal oil ratio.

The greases object of the present invention can be obtained also by mixing an hydrogen-based grease previously prepared with the perfluoropolyethereal oil. Alternatively the perfluoropolyethereal oil is previously mixed with an organic or inorganic thickener for obtaining a grease having a fluorinated basis, which is then mixed with a hydrogen-based oil or grease.

The thickener can be also completely or partially fluorinated and can be same or different in hydrogenated greases and in fluorinated greases.

The preferred fluorinated thickener is polytetrafluoroethylene (PTFE) having a number average molecular weight from 300,000 to 800,000, preferably from 500,000 to 600,000, having average size from 4 to 10 micron, the particles being of spheroidal type. PTFE having a number average molecular weight from $10^6$ to $10^7$ can also be utilized. The PTFE for instance is, PTFE powder Algoflon$^{(R)}$ L206 type, having a molecular weight from 600000 and particle average size from 7 to 10 micron.

The fluoropolyethereal oil used in the compositions of the present invention is a fluoropolyethereal liquid comprising the fluorooxyalkylene units statistically distributed along the chain belonging to one or more of (CFXO) types, where X is F or $CF_3$, $(CF_2CF_2O)$, $(CF_2CF(CF_3)O)$, $(CF_2CF_2CF_2O)$.

The compounds having a fluoropolyethereal structure are preferably selected from the following classes of compounds comprising the constituent units of the type indicated hereinunder:

1) ($C_3F_6O$) and (CFXO) statistically distributed along the chain of perfluoropolyether, wherein X is F or $CF_3$;

2) ($C_3F_6O$), of the linear ($CF_2CF_2CF_2O$) or branched ($CF_2CF(CF_3)O$) type;

3) ($C_3F_6O$), ($C_2F_4O$), (CFXO), statistically distributed along the chain of perfluoropolyether, wherein X is F or $CF_3$.

4) ($C_2F_4O$), ($CF_2O$) statistically distributed along the chain of perfluoropolyether.

The viscosity of the fluoropolyethereal oils ranges from about 10 to 4000 cSt, preferably from 40 to 2000. The aforesaid fluoropolyethers have fluoroalkyl neutral termiinals, optionally comprising chloro and/or hydrogen atoms.

They are products easily available in trade, such as Fomblin$^{(R)}$, Krytox$^{(R)}$ and Demnum$^{(R)}$.

Among the preferred fluoropolyethers the following classes can be cited:

1. $A'O(CF_2—\underset{\underset{CF_3}{|}}{CFO})_m(CFXO)_n—A$ wherein X is —F, —$CF_3$; A and A', same or different from each other, can be $CF_3$, $C_2F_5$, $C_3F_7$, —$CF_2T$, $$—\underset{\underset{T}{|}}{CF}—CF_3\ ,$$

wherein T=H, Cl. The units ($CF_2CF(CF_3)O$) and (CFXO) are statistically distributed along the perfluoropolyethereal chain, m and n are integers such that the ratio m/n=20–1000 and the viscosity of the perfluoropolyether is from 10 to 4000 cSt.

These perfluoropolyethers are obtained by photooxidation reaction of hexafluoropropene, for instance according to the process described in GB Patent 1,104,482 and with subsequent conversion of the terminal groups to inert groups according to the process described in GB Patent 1,226,566, EP 340739 and subsequent fluorination.

2. $C_3F_7O(\underset{\underset{CF_3}{|}}{CF}—CF_2O)_{m'}—B$ wherein B can be —$C_2F_5$, —$C_3F_7$, and m' is a positive integer, such that the viscosity of the product is within the range indicated above for the class 1.

These compounds are prepared by ionic oligomerization of hexafluoropropene epoxide and subsequent treatment of the acyl fluoride (COF) with fluorine according to the processes shown in U.S. Pat. No. 2,242,218.

3. $\left[C_3F_7O(\underset{\underset{CF_3}{|}}{CF}—CF_2O)_{m''}—\underset{\underset{CF_3}{|}}{CF}\right]_2$ wherein m" is an integer such that the viscosity of the product is within the above mentioned range.

These products are obtained by ionic telomerization of hexafluoropropene epoxide and subsequent photochemical dimerization of the acylfluoride, according to the processes described in U.S. Pat. No. 3,214,478.

4. $A''O[CF_2CF(CF_3)O]_{q'}—(C_2F_4O)_{s'}(CFXO)_{r'}A'''$ wherein A" and A"', same or different from each other, can be $CF_3$, $C_2F_5$, $C_3F_7$; X is F, $CF_3$; r', q' and s' are integers and can be also 0, but in any case they are such that the viscosity of the perfluoropolyether is within the range indicated above; the ratios $r'/(r'+s'+q') \leqq 1/10$; q'/s' between 0.2 and 6.

These products are obtained by photooxidation of mixtures of $C_3F_6$ and $C_2F_4$ and subsequent treatment with fluorine according to the processes described in U.S. Pat. No. 3,665,041, EP 344,547 and 340,793.

5. $CF_3O(C_2F_4O)_p(CF_2O)_q—CF_3$ wherein p and q are integers, same or different from each other, with p/q ratio comprised between 0.1 and 5 and such that the viscosity is within the limits indicated above.

These perfluoropolyethers are prepared by photochemical oxidation of $C_2F_4$ according to U.S. Pat. No. 3,715,378 and subsequent treatment of the product of the photooxidation with fluorine according to U.S. Pat. No. 3,665,041.

6. $A^{iv}O—(CF_2—CF_2—CF_2O)_{m'''}A^{v}$ wherein $A^{iv}$ and $A^{v}$, equal or different from each other, can be $C_2F_5$, $C_3F_7$ and m"' is an integer such that the viscosity of the product is comprised within the values indicated above.

These products are obtained according to European patent No. 148,482.

7. $DO—(CF_2—CF_2O)_rD'$ wherein D and D', same or different from each other, can be $CF_3$, $C_2F_5$ and r is an integer such that the viscosity of the product is comprised within the values indicated above.

These products are obtained according to U.S. Pat. No. 4,523,039.

8. $R'_f\left[\underset{\underset{CF_3}{|}}{\overset{\overset{CF_3}{|}}{C}}—O—\underset{\underset{R_f}{|}}{\overset{\overset{R_f}{|}}{C}}—\underset{\underset{R_f}{|}}{\overset{\overset{R_f}{|}}{C}}—O\right]_{n'}R'_f$ wherein $R'_f$ is a perfluoroalkyl, $R_f$ is F or a perfluoroalkyl, n' is such that the viscosity is within the limits indicated above. These perfluoropolyethers are described in the PCT patent application WO 87/00538.

The fluoropolyethers utilized in the compositions of the invention can also partly contain, up to 10% by weight of the fluorinated oil, fluoropolyethers having one, two or more reactive terminal groups in the structures indicated above. The terminals are for instance formed by acylfluoride, carboxylic, alcoholic, ketonic, amidic, aminic, alkoxylic and nitrilic groups, as described in detail in patent applications EP 435062, EP 382224 in the name of the Applicant. In such a case the antiwear and anticorrosion properties of the grease are improved.

As hydrogenated base oil in the lubricating compositions of the present invention, any oil selected from a mineral oil of hydrocarbon type, an animal or vegetable oil, a synthetic oil like for instance polyester, silicone, polyalphaolefin, polyglycols can be used. The hydrogenated oil can also be a mixture of the aforesaid oils.

The thickening agent which is mixed with the oils in the lubricating compositions of the present invention increases the viscosity thereof up to transforming them into greases.

According to the present invention, as thickening agents one can use for instance the agents commonly used with hydrogenated greases, such as for instance metal soaps, bentonite, polyureas, very finely pulverized silica, terephthalamic acid salts and the like, and the agents commonly used in the case of fluorinated oils, in particular finely pulverized polytetrafluoroethylene.

The lubricating compositions according to this invention can contain various additives of the types commonly used in lubricating oils and in greases, such as for instance antioxidants, anticorrosion, antiwear, additives for the use under extreme pressure, other solid lubricants and viscosity index improvers.

The process for preparing lubricating compositions according to the present invention comprises mixing at least a lubricating oil, a fluoropolyethereal oil and a thickening agent as essential components. They can be mixed for obtaining the greases of the invention according to any modality.

The processes which can be indicated are the following:

(1) the three components are mixed together at the same time;

(2) the thickening agent is mixed with the hydrogen-based oil and the mixture is mixed with the fluoropolyethereal organic oil, i.e. the fluorinated organic oil is added to the grease previously prepared with the hydrogen-based oil;

(3) the fluoropolyetheral oil, containing polytetrafluoroethylene or a similar polymer having low molecular weight as thickening agent, is mixed with the lubricating oil;

(4) the thickening agent is mixed with the hydrogen-based oil and the grease so obtained is mixed with the grease separately prepared from thickeners, organic and inorganic, fluorinated and non, with the fluoropolyethereal oil.

Mixing is carried out in suitable equipment by adding the components according to one of the processes indicated, adding also the optional additives.

For instance, one can start by mixing the hydrogen-based lubricating oil with the thickening agent according to the conventional technique for preparing greases. To the product so obtained it is then added, gradually, the fluorinated oil (or the fluorinated grease in which the fluorinated oil has been previously mixed with a thickener, for instance polytetrafluoroethylene) till obtaining the desired composition. The mixture so obtained is passed at last in an homogenizer, for instance of Manto Galvin type or in a three cylinder homogenizer and the temperature during homogenization is preferably comprised between 20° and 50° C.

The number of treatments in the homogenizer should preferably be two or three times the number of treatments carried out on a normal non fluorinated grease for obtaining a good homogenization.

Examples are reported hereinunder for illustrative purpose, but not limitative of the scope of the invention. The components used in preparing the compositions of the examples and of the comparative examples and the methods used in characterizing said compositions are the following:

Components

Hydrogen-based grease: it is prepared adding to a naphthenic mineral oil or to an ester of trimellitic acid a thickening agent and other additives in the ratios indicated in Table 1.

Fluorinated grease: it is prepared by adding to the fluoropolyethereal oil "Fomblin$^{(R)}$ Y45" or "Fomblin$^{(R)}$ Y25" (produced by Ausimont) polytetrafluoroethylene "Algoflon$^{(R)}$ L 206" (produced by Ausimont) as thickening agent (see Table 2).

Fluorinated oil: the fluoropolyethereal oil "Fomblin$^{(R)}$ Y 25" or "Fomblin$^{(R)}$ Y45" (produced by Ausimont) is used (see Table 3).

Characterizing Methods

Characterization at low temperature: the ASTM D 1478 method is used for determining the torque in the study of the correlation of temperature and torque.

minimum working temperature: in the correlation of temperature and torque, the temperature at which the torque shows a quick increase when the temperature is allowed to fall, is said minimum working temperature (see FIG. 1, Table 4).

locking temperature: in said correlation of temperature and torque, the temperature at which the torque reaches a value of 1,274 Nm is said locking temperature (see FIG. 1, Table 5).

Evaporation: ASTM D 972 method is used to determine the per cent evaporation of the oil at the temperature of 149° C. after a period of 22 hours (see FIG. 1, Table 6).

Separation of oil: FTMS 791/321 method is used to determine the per cent separation of the oil at the temperature of 149° C. after a period of 30 hours (see Table 7).

Wear: ASTM 2266 method is used.

Welding load: IP 239 method is used (see Table 8).

Herz average load: IP 239 method (see Table 8).

operating time at high temperature: the operating time of the FAG type 6204 bearing is measured in the following conditions:

temperature: 170–175° C.

number of revolutions: 10,000 rpm

Load in radial direction: 31.25 kg

Load in axial direction: 2.5 kg

Stop of 68 hours every 100 hour operation (see Table 9).

The characterization is reported in the Tables and hereinunder.

EXAMPLES 1–4

The hydrogen-based greases A, B, C and D of Table 1, obtained by previously mixing the lubricating oil and the thickening agent and the other additives indicated, were mixed with the fluorinated grease indicated in table 2 in the weight ratio 90/10, obtaining lubricating compositions of which the physical and tribologic properties and the operating time at high temperature were subsequently determined.

COMPARATIVE EXAMPLES 1–4

The physical and tribologic properties of said greases A, B, C and D, i.e. of the compositions of examples 1–4 free of fluorinated grease, were determined.

EXAMPLES 5–6

The perfluoropolyether oil Fomblin$^{(R)}$ Y 25, mixed with the grease having an hydrogenated basis previously prepared in the ratios indicated in Table 3, was used for preparing lubricating compositions of which the operating time at high temperature and the physical and tribologic properties were measured.

COMPARATIVE EXAMPLES 5–6

The components used in examples 5 and 6 but the perfluoropolyethereal oil were used for preparing lubricating compositions of which the properties were then measured.

COMPARATIVE EXAMPLES 7 and 8

The properties of the fluorinated grease used for preparing the compositions of examples 1–4 were measured.

Characteristics at low temperature: Tables 4–5

In Tables 4 and 5 the values of the "Minimum Working Temperature" and of the "Locking Temperature" of the greases object of the present invention are respectively compared with the ones of quite hydrogenated or quite fluorinated base greases.

Table 4

By comparing, in Table 4, the values of the "Minimum Working Temperature" of the greases of Ex. 1–2–3–4, object of the present invention, with the ones of the corresponding hydrogen-based greases free of fluorinated oil, it is noticed that the minimum working temperature is about −40° C., optimal temperature for most applications.

By comparing said values of the mixed greases of ex. 1–2–3–4, partly containing the perfluorinated grease, with the ones of the perfluorinated grease alone (comparative example 7) it clearly appears that, due to the formulation, the minimum working temperature of the grease of comparative ex. 7 was reduced, obtain the aim that a minimum working temperature of about −40° C. was reached.

By comparing the minimum working temperature of the grease of comparative ex. 7 with the one of the grease of comparative ex. 8, it is shown that the aim of reducing said temperature can be obtained by decreasing the viscosity of the perfluorinated oil used for the formulation of the perfluorinated grease (the viscosity of oil Fomblin(R) Y 25 used for preparing the grease of ex. 8 is, in fact, lower than that of oil Fomblin(R) Y 45 used for preparing the grease of ex. 7. However it must be noted that this will be to the detriment of the maximum using temperature of the grease (ex. 8) formulated with Fomblin(R) because of its higher volatility (see the following Tables).

Therefore it is preferable, on the basis of the following Tables, to use the fluorinated grease containing the fluorinated oil of superior viscosity (ex. 7). This result is unexpected: though using a fluorinated grease having a minimum working temperature of −30° C., it is possible to obtain a mixed grease according to the present invention having a minimum working temperature of about −40° C.

Table 5

The improvement of the behaviour at low temperature of perfluorinated greases (comparative ex. 7 and 8), transformed into mixed greases (Ex. 1–2–3–4), object of the present invention, is confirmed also by the values reported in Table 5 containing the "Locking Temperature or Locking Point" values. The locking temperature is of the same order as the one of hydrogen-based greases (comparative ex. from 1 to 6) and is better than that of fluorinated greases of comparative ex. 7 and 8, independently from the viscosity of the fluorinated oil.

Characteristics at high temperature: Tables 6–7

In Tables 6 and 7 the values of the "Weight loss by evaporation" and of the "Oil separation" of the greases object of the present invention are compared, respectively, with those of the quite hydrogenated or quite fluorinated base greases.

Table 6

By considering the data reported in Table 6 it is noticed that the mixed greases (ex. from 1 to 6) have weight loss by evaporation of the same order or even sensibly lower than that of the corresponding hydrogen-based greases.

From the same Table it is pointed out that the highest weight loss of mixed greases by evaporation compared with that of perfluorinated greases is contained within acceptable operating limits.

Table 7

Table 7 compares the values of the "Oil separation" of the mixed greases, object of the present invention, with those of the hydrogen-based greases (Ex. from 1 to 6) and with those of the perfluorinated greases (comparative ex. 7 and 8).

The "Oil separation" is a very important characteristic for applications, especially at high temperature.

In all cases the oil separation of mixed greases is clearly lower than that of the corresponding hydrogen-based greases; it is also generally lower than that of the perfluorinated greases.

This result is quite unexpected because of the total incompatibility of fluorinated oils with components having an hydrogenated basis.

On the basis of the values of the properties discussed with reference to Tables 4–5–6–7, it can be pointed out that the greases object of the present invention offer a widening of the range of the working temperature compared with both that of the hydrogenated greases and that of the fluorinated greases.

Tribologic characteristics: Table 8

In Table 8 the values of the "Wear", of "Welding load" and of the Herz Average Load" of the greases object of the present invention are compared, respectively, with those of the hydrogenated or perfluorinated base greases.

From the data reported in the Table it can be deduced that in case of mixed greases the wear has been improved (i.e. it is lower) in most cases both with respect to the one of hydrogenated greases and to the one of perfluorinated greases.

As regards the Welding Load and the Herz Average Load the respective values relating to mixed greases result better than the ones of the hydrogenated greases.

Operating performances: Table 9

In Table 9 the data of the "Operating Life at High Temperature" of the greases object of the present invention are compared with those of the hydrogenated greases.

The data obtained show that there is a clear improvement of the life of the greases object of the present invention compared with that of the hydrogenated greases; said improvement can be expressed with a factor of at least 4.

From all the data reported it has been unexpectedly found that it is possible to substantially improve the durability of an hydrogenated grease maintaining the other properties at an optimal level for most of the applications.

From a practical point of view the greases of the invention have a cost/performance ratio clearly better than that of the known hydrogenated and fluorinated greases.

TABLE 1

COMPOSITION OF THE HYDROGENATED BASE GREASES

| Components | A | B | C | D |
|---|---|---|---|---|
| Oil: SR 130 mineral oil (of naphthenic type) | 41.2 | — | 46.3 | — |
| Oil: Priolube ® 3985 ester (UNICHEMA) | 40.77 | 82.2 | 34.75 | 82.8 |
| Thickening agent: | | | | |
| KOMAD ® 35 (MINERALIMPEX) | 14.0 | 13.8 | — | — |
| Benzoic acid | 2.38 | 2.35 | — | — |
| Thickening agent: | | | | |
| 12-Hydroxystearic acid | — | — | 10.6 | 9.5 |
| Azelaic acid | — | — | 3.6 | 3.25 |
| Lithium hydroxide | — | — | 3.1 | 2.8 |
| Additives: | | | | |
| IRGANOX ® L 101 (CIBA GEIGY) | 1.0 | 1.0 | 1.0 | 1.0 |
| ETHYL ® 703 (ETHYL CORP.) | 0.5 | 0.5 | 0.5 | 0.5 |
| REOMET ® 39 (CIBA GEIGY) | 0.15 | 0.15 | 0.15 | 0.15 |

TABLE 2

Greases with fluorinated oil under the form of fluorinated grease

| | | EXAMPLE No. | | | | COMPARATIVE EXAMPLES | | | | | |
|---|---|---|---|---|---|---|---|---|---|---|---|
| | | 1 | 2 | 3 | 4 | 1 | 2 | 3 | 4 | 7 | 8 |
| Grease | A | 90 | | | | 100 | | | | | |
| | B | | 90 | | | | 100 | | | | |
| | C | | | 90 | | | | 100 | | | |
| | D | | | | 90 | | | | 100 | | |
| Perfluorinated oil FOMBLIN ® Y 45 | | 6.5 | 6.5 | 6.5 | 6.5 | | | | | 65 | |
| Perfluorinated oil FOMBLIN ® Y 25 | | | | | | | | | | | 70 |
| PTFE ALGOFLON ® L206 | | 3.5 | 3.5 | 3.5 | 3.5 | | | | | 35 | 30 |

TABLE 3

Hydrogenated greases with fluorinated oil

| | Example No. | | Comparative Examples No. | |
|---|---|---|---|---|
| | 5 | 6 | 5 | 6 |
| Oil: | | | | |
| Mineral oil SR 130 | — | 29.5 | — | 39.8 |
| REOLUBE ® TM10 Ester (CIBA GEIGY) | 49.2 | 25.5 | 66.8 | 34.4 |
| Thickening agent: | | | | |
| Claytone (Bentonite) | 14.5 | — | — | 19.8 |
| Acetone | 2.6 | — | — | 3.5 |
| PENTAMID ® KH (PENTAGON CHEM. LIMITED) | — | 8.9 | — | 12.0 |
| Benzoic acid | — | 2.1 | — | 2.9 |
| Sodium hydroxide | — | 1.5 | — | 2.1 |
| Additives: | | | | |
| IRGANOX ® L 101 (CIBA GEIGY) | 4.3 | 3.2 | 5.9 | 4.3 |
| IRGANOX ® L 115 (CIBA GEIGY) | — | 2.1 | — | 2.9 |
| ETHYL ® 703 (ETHYL CORP.) | 2.1 | — | 2.9 | — |
| REOMET ® 39 (CIBA GEIGY) | 0.8 | 1.2 | 1.1 | 1.6 |
| Perfluorinated oil FOMBLIN ® Y25 | 26.5 | 26 | | |

TABLE 4

"Minimum Working Temperature" (ASTM D1478)

| Example No. | Min. Working Time | Comp. Ex. No. | Min. working Time °C. |
|---|---|---|---|
| 1 | −38 | 1 | −40 |
| 2 | −41 | 2 | −45 |
| 3 | −40 | 3 | −40 |
| 4 | −41 | 4 | −45 |
| 5 | −42 | 5 | −45 |
| 6 | −42 | 6 | −45 |
| 7 | — | 7 | −30 |
| 8 | — | 8 | −40 |

TABLE 5

"Locking temperature" i.e. temperature at which a bearing locks (ASTM D1478)

| Ex. No. | Locking temperature (°C.) | Comp. Ex. No. | Locking temperature (°C.) |
|---|---|---|---|
| 1 | −54 | 1 | −54 |
| 2 | −61 | 2 | −60 |
| 3 | −55 | 3 | −54 |
| 4 | −60 | 4 | −61 |
| 5 | −50 | 5 | −53 |
| 6 | −52 | 6 | −54 |
| 7 | — | 7 | −47 |
| 8 | — | 8 | −49 |

TABLE 6

Weight loss by evaporation at 149° C. × 22 hours (ASTM D972)

| | Weight loss by evaporation | | |
|---|---|---|---|
| Ex. No. | % by weight | Comparative Ex. No. | % by weight |
| 1 | 1.88 | 1 | 1.87 |
| 2 | 1.34 | 2 | 1.45 |
| 3 | 2.42 | 3 | 2.53 |
| 4 | 1.96 | 4 | 2.34 |
| 5 | 2.50 | 5 | 3.8 |
| 6 | 2.40 | 6 | 3.9 |
| 7 | — | 7 | 0.29 |
| 8 | — | 8 | 1.90 |

TABLE 7

Oil separation at 149° C. for 30 hours (FTMS 791/321)

| | Oil separation | | |
|---|---|---|---|
| Example No. | % by weight | Comp. Example No. | % by weight |
| 1 | 1.52 | 1 | 5.19 |
| 2 | 3.12 | 2 | 9.10 |
| 3 | 5.90 | 3 | 9.08 |
| 4 | 0.25 | 4 | 2.38 |
| 5 | 2.50 | 5 | 6.90 |
| 6 | 7.90 | 6 | 19.61 |
| 7 | — | 7 | 4.24 |
| 8 | — | 8 | 5.50 |

TABLE 8

| Ex. No. | Wear (ASTM D 2266) (mm) | Welding Load (IP 239) (Kg) | Hertz Average Load (IS 239) | Comparative Example No. | Wear (ASTM D2266) (mm) | Welding Load (IP 239) (Kg) | Herz Average Load (IP 239) (Kg) |
|---|---|---|---|---|---|---|---|
| | Tribologic characteristics | | | | | | |
| 1 | 0.67 | 158 | 42 | 1 | 0.53 | 141 | 38 |
| 2 | 0.65 | 158 | 47 | 2 | 0.76 | 141 | 34 |
| 3 | 0.63 | 200 | 43 | 3 | 0.74 | 178 | 35 |
| 4 | 0.72 | 224 | 57 | 4 | 0.92 | 200 | 43 |
| 5 | 0.83 | 200 | 80 | 5 | 0.70 | 178 | 65 |
| 6 | 0.74 | 200 | 85 | 6 | 0.68 | 178 | 68 |
| 7 | — | — | — | 7 | 1.19 | 708 | 115 |
| 8 | — | — | — | 8 | 0.88 | 355 | 105 |

TABLE 9

| Operating life at high temperature | | | |
|---|---|---|---|
| Operating life at high temperature | | | |
| Ex. No. | Hours | Comp. Ex. No. | Hours |
| 2 | 147 | 2 | 35 |
| 5 | 680 | 5 | 155 |
| 6 | >1500 | 6 | 207 |

| Test conditions: | |
|---|---|
| Temperature: | 170–175° C. |
| Bearing rotating rate: | 10.000 rpm |
| Load in radial direction: | 31.25 Kg |
| Load in axial direction: | 2.50 Kg |
| Stop of 68 hours every 100-hour rotation. | |

We claim:

1. A method for improving the minium working temperature and maximum working temperature of greases containing a lubricating oil selected from the group consisting of a hydrocarbon based mineral oil, an animal oil or vegetable oil, polyesters, polyalphaolefins, silicone, and polyglycols;

comprising adding thereto a fluoropolyethereal oil and an organic or inorganic thickening agent, the weight ratio of the lubricating oil+fluoropolyethereal oil/thickening agent ranges from 97:3 to 80:20 and the weight ratio of lubricating oil/fluoropolyethereal oil ranges from 95:5 to 60:40, and said fluoropolyethereal oil has a viscosity range from 10 to 4000 cst and are selected from the following structures:

1.

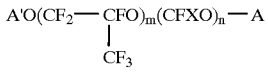

wherein X is —F, —$CF_3$; A' and A are the same or different from each other and are —$CF_3$,

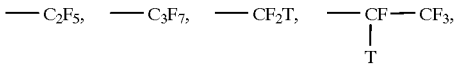

wherein T is H or Cl, the units ($CF_2CF(CF_3)O$) and (CFXO) are statistically distributed along the perfluoropolyethereal chain, m and n are integers wherein the ratio of m/n is 20–1000;

2.

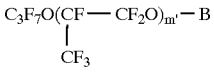

wherein B is $CF_3$—$C_2F_5$, —$C_3F_7$, and m' is a positive integer;

3.

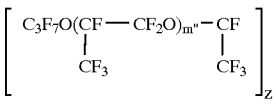

wherein m" is an integer;

4. $A''O[CF_2CF(CF_3)O]_{q'}(C_2F_4O)_{s'}(CFXO)_{r'}A'''$ wherein A" and A"' are the same or different and are selected from the group consisting of $CF_3$, $C_2F_5$, $C_3F_7$; X is F, $CF_3$; r', q' and s' are integers and can be also equal to 0, with the proviso that the viscosity of the perfluoropolyether is within the range indicated above; the ratios $r'/(r'+s'+q') \leqq 1/10$; q'/s' is between 0.2 to 6;

5. $CF_3O(C_2F_4O)_p(CF_2O)_q$—$CF_3$ wherein p and q are integers which are the same or different and with the proviso that the p/q ratio is comprised between 0.1 and 5 and such that the viscosity is within the limits above indicated;

6. $A^{iv}O$—$[CF_2CF_2CF_2O)_{m'''}A^{v}$ wherein $A^{iv}$ and $A^{v}$, are the same or different and are selected from the group consisting of $C_2F_5$, $C_3F_7$ and m"' is an integer;

7. DO—$(CF_2$—$CF_2O)_rD'$ wherein D and D' are the same or different and are selected from the group consisting of $CF_3$, $C_2F_5$, and r is an integer;

8.

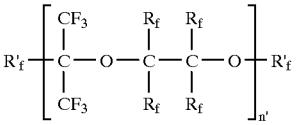

wherein $R'_f$ is a perfluoroalkyl, $R_f$ is F or a perfluoroalkyl, n' is an interger.

2. The method of claim 1 wherein the weight ratio of the lubricating oil+fluoropolyethereal oil/thickening agent ranges from 97:3 to 88:12 and weight ratio of lubricating oil/fluoropolyethereal oil ranges from 80:20 to 70:30.

3. The method of claim 1 wherein the fluoropolyethereal oil is mixed with pre-pared grease.

4. The method of claim 1 wherein the fluoropolyethereal oil is mixed with the thickening agent creating a fluoropolyethereal oil/thickening agent mixture which in turn is mixed with a pre-pared grease.

5. The method of claim 4 wherein the thickening agent is polytetrafluoroethylene powder.

6. The method of claim 1 wherein the fluoropolyethereal oil is a liquid comprising fluorooxyalkylene units statistically distributed along the chain belonging to one or more of (CFXO) types, wherein X is F or $CF_3$, ($CF_2CF_2O$), ($CF_2CF(CF_3O)$, and ($CF_2CF_2CF_2O$).

7. The method according to claim 6, wherein the fluoropolyether compounds of the fluoropolyethereal oil have fluoroalkylic neutral terminals, optionally comprising chlorine and/or hydrogen atoms.

8. The method of claim 7, wherein fluoropolyether compoounds are selected from the group of compounds comprising the following constitutents:

($CF_6O$) and (CFXO) statistically distributed along the chaiu of perfluoropolyether, wherein X is —F or $CF_3$;

($C_3F_6O$), linear ($CF_2CF_2CF_2O$) or branched ($CF_2CF(CF_3)O$);

($C_3F_6O$), ($C_2F_4O$), (CFXO0, statistically distributed along the chain of perfluoropolyether, wherein X is —F or $CF_3$; and ($C_2F_4O$), statistically distributed along the chain of perfluoropolyether.

9. The method according to claim 1 wherein the viscosity of the flouropolyethereal oil varies from about 40 to 2000 cSt.

10. The method according to claim 1 wherein the fluoropolyethereal oil further contains up to 10% by weight, of fluoropolyethereal oil having one or more reactive terminal groups based on the fluoropolyethereal oil mixture.

11. The method according to claim 10, wherein the reactive terminal groups are selected from the group consisting of acylfluoride, carboxyl, alcohol, ketone, amide, amine, alkoxylic and nitrile.

12. The method according to claim 1, further comprising adding at least one additive to the grease selected from the group consisting of antioxidants, anticorrosives, antiwears, extreme pressure agents, and viscosity index improvers.

13. The method for preparing greases of claim 1, comprising mixing a grease with the fluoropolyethereal oil to produce a mixture, and subsequently homogenizing the mixture at temperatures from 20° C. to 50° C. by passing the mixture in a three cylinder homogenizer at least two times.

14. The method of claim 13 wherein the fluoropolyethereal oil is in the form of a fluorinated grease.

* * * * *

UNITED STATES PATENT AND TRADEMARK OFFICE

CERTIFICATE OF CORRECTION

PATENT NO. : 5,948,737

DATED : September 7, 1999

INVENTOR(S) : SRINIVASAN et al.

It is certified that error appears in the above-identified patent and that said Letters Patent is hereby corrected as shown below:

On the title page,
Item [30], line 1, delete "Jan. 12, 1993" insert therefor

-- Dec. 1, 1993 --

Signed and Sealed this

Twenty-ninth Day of February, 2000

*Attest:*

*Attesting Officer*

Q. TODD DICKINSON

*Commissioner of Patents and Trademarks*